United States Patent [19]

Parry

[11] Patent Number: 4,530,473

[45] Date of Patent: Jul. 23, 1985

[54] APPARATUS FOR APPLICATION OF PLASTICS STRETCH FILMS

[76] Inventor: John C. Parry, 6729 Brookmont Dr., Baltimore, Md. 21207

[21] Appl. No.: 454,144

[22] Filed: Feb. 4, 1983

[51] Int. Cl.[3] ..... B65H 75/38

[52] U.S. Cl. ..... 242/55.3; 242/96; 242/99

[58] Field of Search ..... 242/96, 99, 68.4, 55.2, 242/55.3, 55.42, 68.3; D8/303; D7/99; 156/576

[56] References Cited

U.S. PATENT DOCUMENTS

| | | | |
|---|---|---|---|
| 3,954,226 | 5/1976 | Pickering | 242/96 |
| 4,172,567 | 10/1979 | Post | 242/96 |
| 4,179,081 | 12/1979 | Parry | 242/99 |
| 4,248,392 | 2/1981 | Parry | 242/99 X |
| 4,372,500 | 2/1983 | Saraisky | 242/55.2 X |

FOREIGN PATENT DOCUMENTS

| | | | |
|---|---|---|---|
| 27664 | 9/1887 | Canada | 242/118.41 |
| 2717728 | 10/1978 | Fed. Rep. of Germany | 242/96 |

*Primary Examiner*—Stuart S. Levy
*Assistant Examiner*—Katherine Jaekel
*Attorney, Agent, or Firm*—Walter G. Finch

[57] ABSTRACT

The invention is an improved apparatus for the manual application of plastics stretch films to materials and items to be packaged and secured as a unit, or packaged and secured to a shipping and transporting device. The apparatus is particularly useful for one-hand operation where the other hand must be used to stabilize the materials or items being packaged or secured in some manner. The apparatus consists of an extended core for the supply of plastics stretch film and at least one tubular-like grip facility for the extended core. Said grip facility serving as a manual control device for the speed of paying out the plastics stretch film material, and as a manual facility for applying tension on the film during the course of applying it to materials and items being packaged or secured. Two one-hand devices may be combined by a simple shaft-like member for operation as a two-hand device.

6 Claims, 6 Drawing Figures

APPARATUS FOR APPLICATION OF PLASTICS STRETCH FILMS

BACKGROUND AND SUMMARY OF THE INVENTION

The invention relates to packaging and shipping systems and in particular to packaging of materials and items to be secured as a unit load or to be secured to a shipping and transporting means, such as a pallet. Specifically, it relates to such systems using plastics stretch film (a high cling film) as the binding and securing agent, and more specifically to an apparatus for such systems that is manually operable with one hand, leaving the other hand free to stabilize the load being secured.

A need has existed for some time for simple means for applying plastics stretch film material. U.S. Pat. Nos. 4,179,081 and 4,248,392, both entitled "Apparatus for Application of Plastics Stretch Films", invented by the present applicant, solved some of the problems and provided a simple and economical means to do the work. However, problems still remain when binding and securing light weight materials and items as a unit load or to a shipping and transporting means, such as a pallet or slip sheet. The present invention solves those problems.

The present invention is for manual operation, but may also be applied to machine applications of the plastics stretch film. The present invention is a one-hand operated dispensing unit which frees the other hand for steadying or stabilizing light weight materials or items, particularly when stacked. The light-weight items may be stacked for binding as a unit load or stacked on a shipping or transporting means as aforementioned. The one-hand device is especially useful when starting the binding wrapping of the plastics stretch film, and when binding the top layers in a stack. In both cases the free hand can be used to hold steady the materials or items and prevent them from sliding out of position as the film is applied for the initial layer or layers of wrapping when the light weight materials or items are not stable at their interface with each other.

The present one-hand device has a simple means included so that it can be converted to a two-hand operation once the materials or items are initially bound or secured sufficiently for a tighter wrapping for movement or for shipment. The simple means for converting to a two-hand device also serves as an efficient means for packaging a pair of the one-hand devices or a package of pairs of the one-hand devices.

In the prior art two methods were available for applying the plastics stretch film material to materials and units to be packaged or secured as hereinbefore described. In addition, now in the prior art, are the two-hand devices of the cited United States Patents, invented by the present applicant.

As described in the two cited U.S. patents, one of the prior art methods is to use a very expensive automatic machine, and the other is to use a commercial manually operated grabbing or holding device which also is very expensive and complicated. The inventions of the two cited United States Patents overcome the problems of the prior art by providing a simple manually operated means for applying the film using two hands, but was unwieldy and unuseable when binding or securing light weight materials or items as hereinbefore described. The present invention overcomes the problems.

The present invention, when used in the manner of the conversion to a two-hand device, also provides another advantage. The conversion means permits the addition of a second one-hand device so that a "roping" effect can be accomplished with a double wrap of narrow strips of plastics film for a tighter and more secure binding of a unit package or load. The details of this "roping" operation is explained hereinafter.

In the prior art the two hand device was unwieldy, as aforementioned, when binding and securing light weight materials and items, particularly when piled or stacked. The cantilever action of the two-hand device was painful and caused a severe bending moment on the wrist when held in one hand. With the extreme cantilever action it was found to be impossible with one hand to make the initial binding wrap on light-weight materials or items.

The very low cantilever action of the one-hand device of the present invention permits the initial binding of light-weight materials and items without the overpowering stress in the wrist of the user. At the same time, the other hand is available to steady or stabilize the pile or stack of materials or items. The completion of the binding and securing of the unit or load can then be accomplished by the continued use of the one-hand device of this invention, or a second one-hand device can be added by the novel and unique coupling means so that it can be operated like a two-hand device. The novel and unique coupling means also provides a simple way of shipping a pair of one-hand units, or packages of a plurality of pairs of one-hand units, as well as being the means by which a pair of one-hand devices can be used like a two-hand device.

The novel and unique coupling means makes it possible to apply the plastics film material in a roping manner of two narrow flat sheets of the plastics film. The roping method adds a criss-cross or "X" pattern that increases the strength and holding power of the plastics film binding wrap.

The roping effect is achieved when two one-hand operated devices are coupled together and periodically or intermittently, while stretching and wrapping the film around materials or items, the hand grip ends are changed to the opposite hands so as to criss-cross lap the flat plastics sheets in the wrapping procedure.

The control of the amount of tension applied to the plastics film to stretch it and to provide a tight gripping force upon the materials or items being bound into a unit or load is by the direct pressure or squeeze of the operator's one hand on the grip end of the one-hand device. The grip or squeeze by the operator is applied on a flexible tube-like device, the flexible tube-like device or grip means being applied around an extended end of the core means of a one-hand roll of the plastics film material.

The coupling means for using two one-hand devices simultaneously and for shipping the devices in pairs is a dowel-like member that is dimensionally longer than the core length of a single one-hand device, but dimensionally shorter than two core lengths of a one-hand device. To couple two one-hand devices to each other for operating as a two-hand device or for shipping a pair of units, the dowel-like member is slideably inserted into the two hollow cylindrical cores of each of the two one-hand units. The diameter of the dowel-like member is dimensionally less than the inside diameter of the core. The grip means on each extended core end of the two one-hand devices are then held and the combination used like a two-hand device.

When using the one-hand device in one hand, the dowel-like member can be left out or placed in the one-hand device in use. If, momentarily, the one-hand device needs a temporary support, the free hand can grip the dowel-like member where it protrudes from the core of the one-hand device in use. The dowel-like member, being dimensionally smaller in diameter than the inside diameter of the core, will move freely in the core. The dowel-like member can, in this case, be gripped tightly by the free hand as only temporary support is necessary.

Two types of hand grips are disclosed in the present invention as components of the invention. One is a tubular-like member with a closed end. The other is an improved hand grip that is also tubular-like, but is improved with a flange means on one end and an inward turned lip on the other end instead of a closed end.

It is, therefore, an object of this invention to provide a plastics film dispensing means that is operable with one hand.

It is another object of this invention to provide a one-hand operated plastics film dispensing means that has a low cantilever action on the wrist of the user.

It is also an object of this invention to provide a one-hand operated plastics film dispensing means in which the operator can "feel" the movement and tension condition through the hand on the flexible hand grip of the device, while the free hand is available to steady and stabilize light weight materials and items being bound and secured as a unit or for shipment.

It is yet another object of this invention to provide a one-hand operated plastics film dispensing means that has a simple coupling means for removably and revolvably affixing a second one-hand operated plastics film dispensing means to the first plastics film dispensing means so that the two one-hand operated plastics film dispensing means may be operated as a two-hand plastics film dispensing means.

It is still another object of this invention to provide a one-hand operated plastics film dispensing means that can apply two plastics films in a roping manner when coupled with a second one-hand operated plastics film dispensing means.

Further objects and advantages of the invention will become apparent in the light of the following description of the preferred embodiments.

DESCRIPTION OF THE PREFERRED EMBODIMENTS

Figure 1:
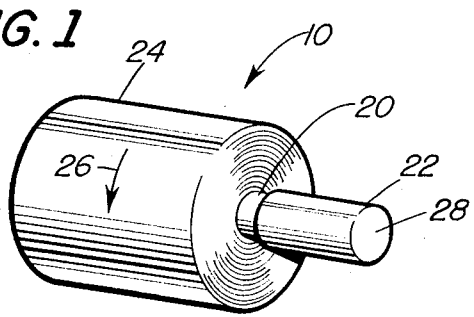
FIG. 1 is a pictorial view of a first embodiment of a one-hand operated dispensing means for plastics film.
Figure 2:
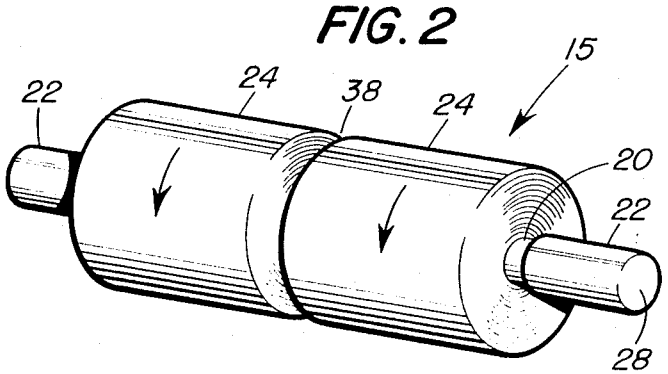
FIG. 2 is a pictorial view of a second embodiment of a first one-hand operated dispensing means for plastics film coupled to a second one-hand operated dispensing means for two-hand operation.

Referring to the drawings and particularly to FIGS. 1 and 2, a first embodiment of the apparatus of this invention is a one-hand operated dispensing means for plastics film and is shown at 10 in FIG. 1. A second embodiment of the apparatus of this invention of a one-hand operated dispensing means for plastics film is shown at 15 in FIG. 2. The second embodiment of a one-hand dispensing means 15 shows two one-hand dispensing means 10 coupled together for operation as a two-hand operated device.

The first embodiment of a one-hand dispensing means 10 for plastics film consists of a core means 20, a single cylindrical flexible hand grip 22 or 52 on one end thereof with a supply of plastics stretch film 24 rolled upon the core means 20 adjacent to and near the opposite end of the core means 20 from the single cylindrical flexible hand grip 22 or 52. A detailed description of the elements and structure of the first embodiment of a one-hand dispensing means 10 for plastics stretch film is provided hereinafter.

The direction of the core wrap of the roll of plastics stretch film 24 on the core means 20 is shown by arrow 26 thereon, however, it is to be understood that the direction of the arrow 26 on such a drawing could be reversed without changing the concept of this invention.

The core means 20 for the first embodiment of a one-hand dispensing means 10 is preferably a hollow tube-like core, however, it is to be understood that a solid rod-like core is within the scope and intent of this invention for the first embodiment. The material for a hollow tube-like core means may be any suitable material such as hard cardboard like material, fiber, plastics, light weight metal, and other similar materials. The core means 20 may be discarded or reused if desired.

The single cylindrical flexible hand grip 22 is hollow and closed at one end 28 only. The inside diameter 30 is a close fit over the outside diameter of core means 20, but with sufficient clearance so that the core means 20 can turn freely within the hand grip 22.

It is to be noted that for initial clarity of illustration, the closed end hand grip 22 is used. However, an improved flange-type hand grip 52 is the preferred embodiment for this invention and is a part thereof. The flange-type hand grip 52 is described in detail later.

Figure 3:
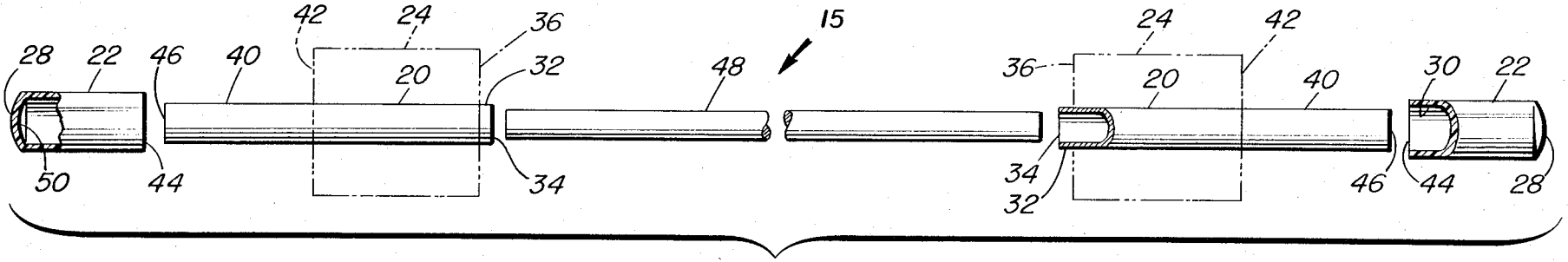
FIG. 3 is an exploded side view of FIG. 2.

The length of the core means 20 can be seen in one piece in FIG. 3 where the hand grip 22 is shown in an exploded relation to the core means 20. The inside diameter 30 of the hand grip 22 is also shown in relation to the outside diameter of the core means 20 in FIG. 3.

The plastics stretch film 24 is rolled upon the core means 20 with a small clearance 32 from the end 34 of the core means 20. This small clearance 32 of the distal edges 36 of the plastics stretch film 24 from the end 34 of the core means 20 provides a small spacing 38 between the distal edges 36 of two rolls of the plastics stretch film 24 when coupled together as in the second embodiment 15 shown in FIG. 2. In FIG. 3 the plastics stretch film 24 is shown in phantom lines for clarity.

The extension 40 of the core means 20 beyond the frontal edges 42 of the roll of plastics stretch film 24 is slightly greater dimensionally than the dimensional length of the cylindrical flexible hand grip 22. The slightly greater dimensional length of the extension 40 of the core means 20 assures that the edges of the open end 44 of the cylindrical flexible hand grip 22 does not touch or interfere with the frontal edges 42 of the roll of plastics stretch film 24.

The clearance thus provided, between the edges of the open end 44 of the cylindrical flexible hand grip 22 and the frontal edges 42 of the roll of plastics stretch film 24, assures that as the roll of plastics stretch film 24 turns or revolves during an application of the film to a unit or load of materials or items it will not rub at a contact or an interface with the edges of the open end 44 of the cylindrical flexible hand grip 22. A rubbing by a contact or interface between the frontal edges 42 and the edges of the open end 44, while the roll of plastics stretch film 24 is turning or revolving, will generate heat by friction and fuse the frontal edges 42 of succeeding adjacent layers of the plastics stretch films 24 to each other. Thus, a portion of the roll of plastics stretch film 24 will be ruined, as the plastics stretch film 24 material tears when pulled apart after such a fusing together of the edges.

The interior surface 50 of the closed end 28 of the cylindrical flexible hand grip 22 interfaces with the hand grip end 46 of the core means 20 and thus prevents the edges of the open end 44 from touching or interfacing with the frontal edges 42 of the plastics stretch film 24, due to the dimensional length of the cylindrical flexible hand grip 22 being less than the dimensional length of the extension 40 of the core means 20.

The cylindrical flexible hand grip 22 may be plastics or any other suitable flexible material. In operation, the user or operator grips the single hand grip 22 on the extension 40 of the core means 20 and gives a slight squeeze to the hand grip 22 in order to "feel" the extension 40 of the core means 20.

In case the initial friction between the hand grip 22 and the core means 20 is too great to obtain a satisfactory "feel" or a free movement, a suitable lubricant, such as a light coating of powder or a wax may be used on the extension 40 or inside the hand grip 22.

As the operator pays out the plastics stretch film 24 during the wrapping of materials or an item, such as to a transporting means, a sufficient grip is maintained on the single hand grip 22 to provide the necessary control of tension on the plastics stretch film 24. The tension is to stretch the film and also to peel the sheet material off of the supply roll of plastics stretch film 24. The control of the tension is gauged by the "feel" of the extension 40 of the core means 20 through the soft flexible hand grip 22.

During this operation of the one hand dispensing means 10, the operator's free hand is used to steady or stabilize the materials or items being bound or secured with the plastics stretch film 24. This steadying or stabilizing is particularly necessary with light weight materials or items which have a tendency to move or slide as the plastics stretch film 24 is pulled against them. Piled or stacked materials or items are particularly unsteady in this manner.

The operator can make a full stop of the turning or revolving of the roll of plastics stretch film 24 and stop the peeling off of layers of plastics stretch film 24 from the roll. To make the stop the operator or user squeezes the cylindrical flexible hand grip 22 tightly. The squeeze of the cylindrical flexible hand grip 22 is a braking action on the turning or revolving core means 20.

The operator or user can have a free running or a controlled peeling off of the layers of plastics stretch film 24 from the roll by a loosening or tightening of the grip on the cylindrical flexible hand grip 22.

Varying the hand squeeze pressure on the cylindrical flexible hand grip 22 permits the control of the paying out of plastics stretch film 24 while also controlling how tightly the plastics stretch film 24 is pulled to provide the wrap to bind and secure the materials or items being packaged or secured. The squeezing of the flexible hand grip 22 provides a braking action that has controlled instantaneous results.

Turning now to the second embodiment of a one-hand operated dispensing means 15, a pictorial view is shown in FIG. 2 and an exploded side view is shown in FIG. 3. It is to be noted that the portion to the left or right in FIG. 3 is also an exploded side view of the first embodiment of a one-hand operated dispensing means 10.

The second embodiment is the use of two one-hand dispensing means 10, coupled together by a coupling means 48, to form the second embodiment of a one-hand operated dispensing means 15.

Note that in coupling the two one-hand dispensing means 10 together with the coupling means 48, the two one-hand dispensing means 10 are oriented in relation to each other by placing the two ends 34 of the two core means 20 facing toward each other. With two one-hand dispensing means so oriented the coupling means 48 is removably and slideably inserted into each of the hollow tube-like core means 20 so as to maintain the orientation. In FIG. 3 the plastics stretch film on the core means 20, is shown in phantom lines for purposes of clarity.

The coupling means 48 is rod-like and may be a solid, the preferred embodiment, but may also be of a tubular configuration. The outside diameter of the coupling means 48 is dimensionally smaller than the inside diameter of the hollow tube-like core means 20. The hollow tube-like core means 20 is able to turn or revolve freely on the coupling means 48 when assembled and when the plastics stretch film 24 is being payed out during an application.

The coupling means 48 is dimensionally longer than one core means 20 so that if and when one end of the coupling means 48 is inside at one end of one of the core means 20, and touching or interfacing with the inside surface 50 of the closed end 28 of the cylindrical flexible hand grip 22, the opposite end of the coupling means 48 will be extended sufficiently into at least a portion of the hollow tube-like core means 20 of the other one-hand dispensing means 10.

Thus, the two one-hand dispensing means 10 are adequately coupled together to form the second embodiment of the one-hand dispensing means 15. In this assembly, the second embodiment of the one-hand dispensing means 15 may be operated in the same manner as a two-hand dispensing means as covered in the aforementioned and cited U.S. patents, invented by the applicant.

In using the second embodiment of the one-hand dispensing means 15, note that after assembly with the coupling means 48 as aforementioned, a cylindrical flexible hand grip 22 is on each end of the assembly so that it can be operated the same as a two-hand dispensing means. However, in the arrangement the structure of the present invention pays out two parallel strips or sheets of plastics stretch film, usually each of narrow width, and permits the aforementioned "roping" effect of a plurality of strips.

The second embodiment of the one-hand dispensing means 15 makes the application of plastics stretch film 24 in the "roping" manner very simple. As the two strips of plastics stretch film 24 are payed out by peeling off of the rolls side by side, the two flexible hand grips 22 are periodically or intermittently switched or exchanged to the opposite hand, while on the extension 40 of the core means 20, and thus causing a twist or flap over of the two side by side sheets or strips of plastics stretch film 24. Thus, the "roping" effect is formed. This "roping" effect strengthens the binding and securing of the unit of load being handled.

The first and second embodiments of one-hand dispensing means, 10 and 15 respectively, for plastics stretch film 24 are ideal for narrow widths of the plastics stretch film 24. The overall short length of the one-hand dispensing means 10, required for the narrow widths of the plastics stretch film 24, results in a low cantilever stress on the wrist when stabilizing light weight materials and items, which is not possible with film dispensing means of the prior art.

It is to be noted that the first embodiment of the one-hand dispensing means 10 can also be used as a two-hand dispensing means. To do this the coupling means 48 is inserted into the hollow tube-like core means 20, as in preparing to set up the second embodiment of a one-hand dispensing means 15, but without adding the second one-hand dispensing means 10.

Then, to use it as a two-hand dispensing means, the operator or user uses one hand to grip the cylindrical flexible hand grip 22 and the other hand to grip the end of the coupling means 48 which protrudes from the hollow tube-like core means 20.

In using the one-hand dispensing means 10 with the coupling means 48 to dispense plastics stretch film 24 in a two-hand procedure it permits a narrow width of plastics stretch film to be used in binding and securing materials or items for movement or shipment. This economical use of the plastics stretch film 24 is useful when the unit package or load is small, or when the unit package or load requires a minimum of binding or securing for short distance movement, such as for intraplant movements.

The first and second embodiments of one-hand dispensing means, 10 and 15 respectively, for plastics stretch film 24 provide two means for using narrow width stretch film. There are numerous uses for the narrow width stretch film 24 that have economic and technical advantages over the use of wide width stretch film normally associated with the two-hand dispenser means of the prior art. The present invention provides the user those options.

It is to be noted further that in using the narrow width plastics stretch film, as provided by the present invention, the "stretch" can be increased by approximately 100% especially when using the second embodiment or the variation of the first embodiment mentioned hereinbefore.

It is also to be noted that the second embodiment of the one-hand dispenser means 15 for plastics stretch film 24 provides a convenient method for shipping pairs of the first embodiment of one-hand dispensing means 10. The first embodiment of the one-hand dispensing means 10, assembled in the form of the second embodiment of the dispensing means 15, is simply packaged that way in a package of two units or multiples thereof. The coupling means 48 stabilizes the two units for packaging.

Figure 5:
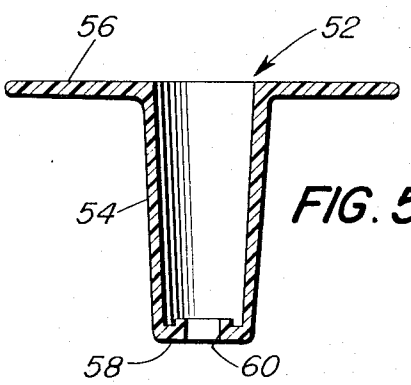
FIG. 5 is a cross sectional view taken on line 5—5 of FIG. 4.
Figure 4:
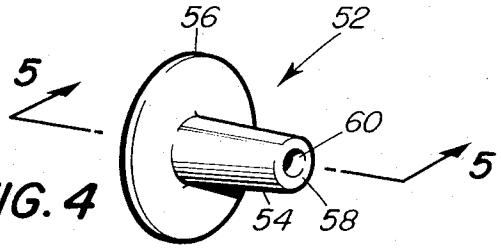
FIG. 4 is a pictorial view of a flange-type hand grip for the dispensing means of plastics film of FIGS. 1 and 2.

It is also to be noted that the one-hand dispensing means 10 or 15 may also use the open end hand grip of the prior art, the closed end hand grip 22 of the prior art and illustrated in FIGS. 1, 2, and 3, or a preferred flange-type hand grip 52 shown in FIGS. 4 and 5 and described hereinafter. The use of the closed end hand grip 22 in FIGS. 1, 2, and 3 is for purposes of clarity in the illustration. The use of the preferred embodiment of the flange-type hand grip 52 operates the same as the closed end hand grip 22, but has additional advantages as described hereinafter.

The closed end hand grip 22, as used in the prior art, but used herein for initial illustration, has two distinct problems which the preferred embodiment of the flange-type hand grip 52 overcomes.

The first problem is that the turning or revolving of the core, such as core means 20, has a tendency to generate frictional heat at the closed end and cut through the closed end, thus then facing the same problems generated by the original prior art open end hand grip. The second problem is that the operator's hand and knuckles rubs on the edges of the roll of plastics stretch film on the core and causes fusing of and tears in the film, similar to problems in the prior art. The rubbing problem occurs regardless of whether the operator is using bare hands or gloved hands. The present invention overcomes these problems.

The flange-type hand grip 52 is of the same material as the closed end hand grip 22 and provides the same "feel", control, and braking action as aforementioned for the closed end hand grip 22. Both of the hand grip means 22 and 52 are monolithically formed. The flange-type hand grip 52 also has and provides the same clearance from the frontal face 42 of the roll of plastics stretch film 24. The flange-type hand grip 52 has substantially the same flexible characteristics as the hand grips 22, and varies in configuration as described hereinafter.

It is to be noted that a hand grip means is a component of the actual total structure of both the first and second embodiments of the dispensing means 10 and 15 for plastics stretch film 24.

The flange-type hand grip 52 consists of a body portion 54, and inboard flange 56, and an outboard inturned lip 58. The cooperation of these elements to form the component flange-type hand grip 52 for the total structure of a dispensing means 10 or 15 for plastics stretch film 24 is described hereinafter.

The inboard and outboard references hereinbefore for the flange-type hand grip 52 refer to the manner in which the component flange-type hand grip 52 is slideably and removably affixed to the end of the core means 20 in the final assembly for use. Inboard refers to the inward side toward the frontal face 42 of the roll of plastics stretch film 24. Outboard refers to the outside end of the extension 40 of the core means 20 away from the frontal face 42 of the roll of plastics stretch film 24 and is the end upon which the improved hand grip 52 is assembled.

The body portion 54, has a slight taper, approximately 1°, from the inboard or flange end to the outboard end. The body portion 54 is substantially cylindrical, except for the aforementioned slight taper, and is hollow or tube-like. The dimensional diameter of the body portion 54 is larger at the inboard end than at the outboard end to provide the taper. The slight taper provides a convenient snugness at the outboard end that is enough to prevent the hand grip 52 from dropping or falling off of the extension 40 of the core means 20 as the dispensing means 10 or 15 is lowered into packing or shipping boxes or cartons. Also, to prevent the hand grip 52 from dropping or falling off when being removed from the shipping boxes or cartons. It is to be understood, however, that a variation in the taper is within the scope and intent of this invention.

The inboard flange 56 is integral and monolithic with the body portion 54 and extends outwardly therefrom. The flange extends outwardly sufficiently to shield the frontal face 42 of the roll of plastics stretch film 24 from being rubbed by the operator's hand and knuckles as the roll of plastics stretch film 24 turns or revolves during application. The plane of the flange 56 is more or less perpendicular to the axis of the body portion 54.

The inturned lip 58 serves essentially the same purpose as the closed end 28 of the hand grip 22. The inturned lip 58 prevents the hand grip 52 from sliding inwardly on the extension 40 of the core means 20. Note that the outboard end 46 of the core means 20 will butt against the inturned lip 58 which prevents the hand grip 52 from sliding inwardly as aforementioned.

The inturned lip 58 is sufficiently large enough to also prevent the coupling means 48 from projecting from or escaping through the open end when two first embodiment dispensing means 10 are combined to form the second embodiment of a dispensing means 15.

The inturned lip 58 of the hand grip 52 is dimensionally thicker than the thickness of closed end 28 of the hand grip 22. This extra thickness provides for the necessary wear and tear due to the turning or revolving outboard end 46 of the core means 20 when plastics stretch film 24 is being applied to packaging from the roll. This eliminates the cutting out of the end as experienced in the prior art.

The inturned lip 58 has an inside diameter 60 such that the aperture opening is sufficiently small so that the coupling means 48 is also held captive within the interior of the core means 20 when used to convert two one-hand dispensing means 10 to a second embodiment of one-hand dispensing means 15.

It is to be noted also that an alternative to making the inturned lip 58 large enough to prevent the coupling means 48 from escaping, the thick inturned lip 58 may be made large enough to take the wear and tear of the outboard end 46 of the core means 20 and then close the balance of the outboard open end of the flange-type hand grip 52, similar to hand grip 22, to prevent the escape of the coupling means. Such an alternative is not shown, but is within the scope and intent of this invention.

Figure 6:
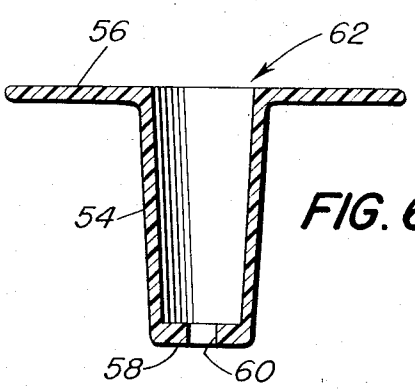
FIG. 6 is a cross sectional view of a modification of FIG. 5.

An alternate method 62 of forming the inturned lip 58 is shown in FIG. 6. The modification 62 to the inturned lip 58 is a straight turning inwardly to form the lip. In the hand grip 52 the inturned lip 58 turns inward and then upward.

The one-hand dispenser means 10 may be operated by left or right handed persons without any modification of the present invention. When the one-hand dispenser means 10 is operated by the two-hand method of holding the coupling means 48 in one hand, as aforementioned, it is essentially a "one brake" hand wrapper instead of the "two brake" hand wrapper in the normal two-hand operation.

Regarding the aforementioned reference to light weight materials or items, such light weight items that require a steadying or stabilizing with the free hand until the initial binding or securing is completed are empty boxes, containers such as empty bottles and cans on trays or separators in multiple layers, boxes or bags of very light weight materials, and other similar items. Often the movement is an in-plant movement or short-haul transfer. The prior art of using string, various types of narrow tape, and other such methods has been most unsatisfactory. The present invention overcomes the problems.

Regarding the "roping" effect, mentioned hereinbefore, which is possible with the second embodiment of the one-hand dispensing means 15, the "roping" effect is particularly useful in overcoming problems encountered in binding and securing piled or stacked boxes. In ordinary binding and securing of boxes in the prior art, the boxes were often crushed. With the present invention, using the two one-hand dispensing means concurrently, the double bands can be applied at the corners of the pile or stack and then with the "roping" effect make the "X" or criss-cross and give the added strength without crushing the boxes.

The one-hand dispensing means 10 is also used to provide a preliminary stabilizing binding on pallet loads that are being moved to a position for subsequent machine wrapping of a binding and securing cover. Without the preliminary stabilizing binding, particularly on light weight materials or items, the machine operation often spills the load or knocks it askew.

It is to be understood that the inside diameter of aperture 60, specified hereinbefore as being small enough to prevent the passage therethrough of coupling means 48, may also be made large enough to permit the coupling means 48 to pass therethrough. Such a variation is within the scope and intent of this invention.

As can be readily understood from the foregoing description of the invention, the present structure can be configured in different modes to provide a one-hand dispensing means for plastics stretch film.

Accordingly, modifications and variations to which the invention is susceptible may be practiced without departing from the scope and intent of the appended claims.

What is claimed is:

1. An apparatus for manually applying plastics stretch films for packaging units, comprising:

a pair of core means, each said core means of said pair of core means having a first end and a second end, each said core means of said pair of core means being hollow and tube-like;

a supply of plastics stretch film on each of said pair of core means, said supply of plastics stretch film on each of said pair of core means being located and rolled upon each respective core means near and spaced slightly from each of said first ends thereof, said spacing of said supply of plastics stretch film on each of said pair of core means from each said first ends being substantially less than the resulting extended spacing of said supply of plastics stretch film on each of said pair of core means from said second ends of each of said core means of said pair of core means;

a pair of hand grip means, each of said pair of hand grip means having an inboard open end and an outboard end, one of said pair of hand grip means with its open end being slideably and removably placed upon said second end of one of said core means of said pair of core means, the other of said pair of hand grip means with its open end being slideably and removably placed upon said second end of the other of said core means of said pair of core means, each of said hand grip means of said pair of hand grip means having its open end spaced from its respective supply of said plastics stretch film; and a coupling means, said coupling means being rod-like in configuration, said coupling means being concurrently removably and slideably inserted into said first ends of said core means for coupling said pair of core means together.

2. An apparatus for manually applying plastics stretch film as recited in claim 1, wherein said pair of hollow, tube-like hand grip means each have a passageway therethrough, an inwardly turned lip means on the outboard end thereof, said inwardly turned lip means being dimensionally thicker than adjacent walls of said hand grip means, said inwardly turned lip means being integral and monolithic with said tube-like hand grip means, said second end of each said core means interfacing with the inboard side of its respective said inwardly turned lip means, said inwardly turned lip means thereby preventing said second end of said core means from passing through and extending outwardly from said respective hand grip means, said inwardly turned lip means causing the opposite open inboard end of its respective hand grip means to be spaced from said supply of plastics stretch film on said core means, said hollow tube-like hand grip means being tapered, the larger end of said tapered hand grip means being at the inboard open end thereof and the smaller end of said tapered hand grip means being at the outboard inwardly turned lip end, and a flange means, said flange means being annular in configuration, said annular flange means being concentrically located around and encircling said hand grip means, said flange means being integral and monolithic with said hand grip means at the inboard open end thereof, said annular flange thereby being spaced from said supply of plastics stretch film on respective core means, the plane of said flange means being substantially perpendicular to the axis of said respective hand grip means, said coupling means being rod-like in configuration.

3. An apparatus for manually applying plastics stretch film as recited in claim 2 wherein said pair of hollow, tube-like hand grip means, each having a passageway therethrough and each having said inwardly turned lip means on the outboard end thereof, each said inwardly turned lip means thereby having said passageway concurrently passing therethrough, each said inwardly turned lip means thereby having an internal diameter, said internal diameter being dimensionally larger than the diameter of said coupling means, whereby said coupling means may be slideably passed through said internal diameter formed by said inwardly turned lip means.

4. An apparatus for manually applying plastics stretch film as recited in claim 2, wherein said pair of hollow tube-like hand grip means, each having said passageway therethrough and each having said inwardly turned lip means on the outboard end thereof, each said inwardly turned lip means thereby having said passageway concurrently passing therethrough, each said inwardly turned lip means thereby having an internal diameter, said internal diameter being dimensionally smaller than the diameter of said coupling means, whereby said coupling means is restricted from passing through said internal diameter formed by said inwardly turned lip means.

5. An apparatus for manually applying plastics stretch film as recited in claim 1, wherein said pair of hand grip means are each cylindrical, hollow, tube-like, flexible, and having a passageway therethrough, each said cylindrical hand grip means thereby encircling said respective core means, at said second end thereof, each said core means having an outside diameter dimensionally slightly less than the inside diameter of said respective hollow, tube-like, and cylindrical hand grip means, so that the inside surface of said hollow, tube-like hand grip means slidingly interfaces with the outside surface of said respective core means, said pair of hand grip means being for the purpose of controlling the tension on said supply of plastics stretch film while being unrolled during manual application for packaging, the dimensional length of each said core means which extends beyond said supply of plastics stretch film thereon at said second end of each said core means is greater than the dimensional length of said respective hand grip means, each said hand grip means length thereby being dimensionally less than the core means on which it is placed where said core means extends beyond said supply of plastics stretch film thereon.

6. An apparatus for manually applying plastics stretch film as recited in claim 5, wherein said pair of hollow, tube-like hand grip means each has one end thereof closed, said closed end being on the outboard end of said respective second end of said respective core means therein, each said closed end thereby causing the inboard open end of each said hand grip means to be spaced from said supply of plastics stretch film on said respective core means.

* * * * *